United States Patent [19]

Luscombe

[11] 4,441,482

[45] Apr. 10, 1984

[54] FIREPLACE INSERT

[76] Inventor: Terry L. Luscombe, Box 108, Armstrong, Iowa 50514

[21] Appl. No.: 181,122

[22] Filed: Aug. 25, 1980

Related U.S. Application Data

[63] Continuation-in-part of Ser. No. 57,413, Jul. 13, 1979, abandoned.

[51] Int. Cl.[3] ..... F24B 7/00

[52] U.S. Cl. ..... 126/123; 126/121; 126/140; 126/83; 126/202

[58] Field of Search ..... 126/120, 121, 123, 131, 126/138, 140, 63, 66, 67, 77, 83, 202, 200; 237/51

[56] References Cited

U.S. PATENT DOCUMENTS

| | | | |
|---|---|---|---|
| 4,050,440 | 9/1977 | Lessin | 126/120 |
| 4,136,662 | 1/1979 | Willson | 126/77 |
| 4,191,162 | 3/1980 | Simms | 126/123 |
| 4,263,889 | 4/1981 | Martenson | 126/123 |

*Primary Examiner*—Samuel Scott
*Assistant Examiner*—Lee E. Barrett
*Attorney, Agent, or Firm*—Williamson, Bains, Moore & Hansen

[57] ABSTRACT

A fireplace insert comprises an inner housing and an outer housing spaced from each other. Thermostatically controlled fans circulate air between the inner and outer housing to cause the air to be efficiently heated before it is distributed into the area or room to be heated. Adjustable vents control the flow of combustion air, and a baffle minimizes the loss of heat through the flue.

5 Claims, 7 Drawing Figures

FIREPLACE INSERT

SUMMARY OF THE INVENTION

This invention relates to a fireplace insert and is a continuation-in-part of my co-pending application Ser. No. 57,413, filed July 13, 1979, entitled, "FIREPLACE HEATER", now abandoned.

The general parameter followed in the design of woodburning stoves is maximum efficiency in heating while providing a stylized, attractive structure. Control of the combustion air and the loss of heat through a flue are two factors effecting the efficiency of woodburning stoves.

It is therefore a general object of this invention to provide a novel, attractive fireplace insert which is arranged and constructed for providing optimum controlled heating efficiency while presenting an attractive, stylized exterior appearance.

More specifically, it is an object of this invention to provide a fireplace insert which not only minimizes the loss of heat through the flue but is designed to effectively circulate and distribute heated air into a room to be heated.

These and other objects and advantages of this invention will more fully appear from the following description made in connection with the accompanying drawings, wherein like reference characters refer to the same or similar throughout the several views.

FIGURES OF THE DRAWINGS

DESCRIPTION OF THE PREFERRED EMBODIMENT OF THE INVENTION

Figure 1:
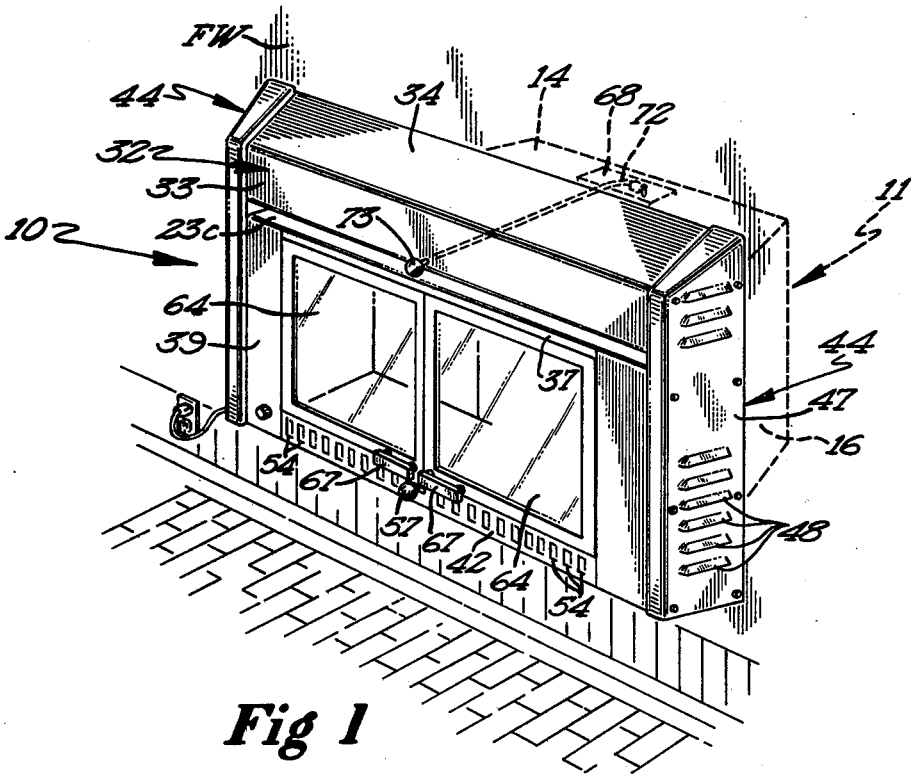
FIG. 1 is a perspective view of the novel fireplace insert.
Figure 2:
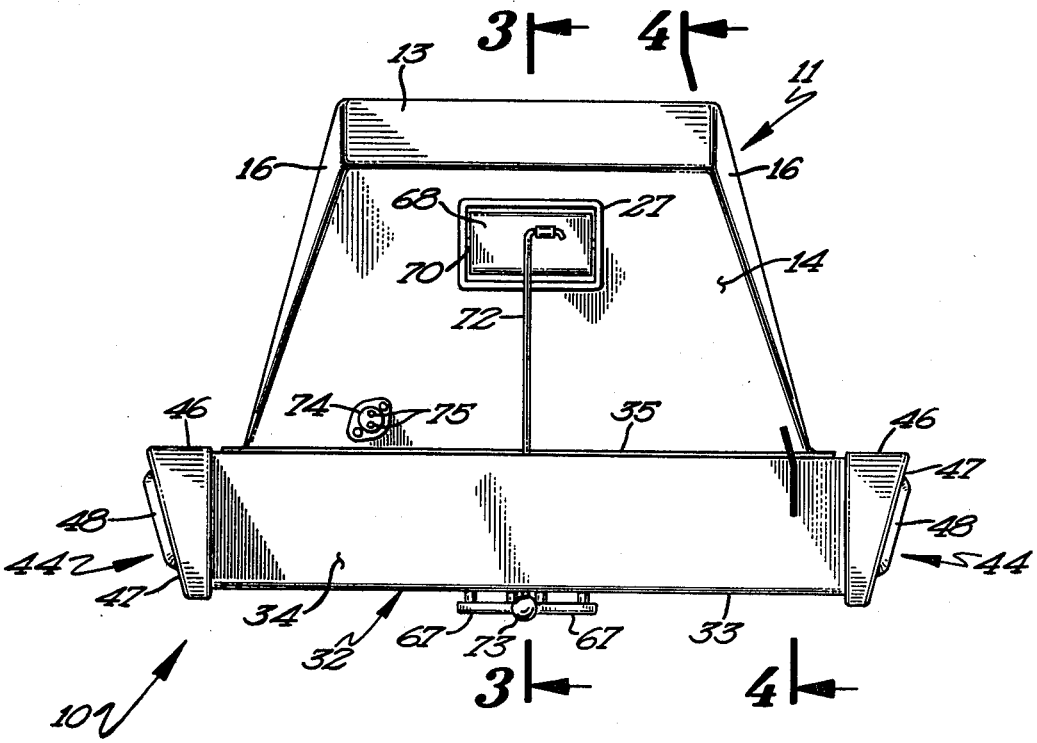
FIG. 2 is a top plan view thereof.

Referring now to the drawings and more specifically to FIG. 1, it will be seen that my novel fireplace insert heater, designated generally by the reference numeral 10 is thereshown. The fireplace insert heater 10 is equipped with an outer housing 11 and an inner housing 12, the latter spaced inwardly of the outer housing. The outer housing 11 includes a substantially flat, rear wall 13, a top wall 14, a bottom wall 15, and side walls 16. It will be noted that the bottom wall 15 has an upturned flange 17 integral with the front edge thereof.

The inner housing 12 includes a substantially flat, rear wall 18, a top wall 19, and side walls 20. The rear wall 18, has an inturned flange 21 integral with the lower edge thereof which engages the upper surface of the bottom wall 15 of the outer housing 11. It will be noted that the rear wall 18, top wall 19, and side walls 20 of the inner housing are respectively spaced from and disposed in parallel relation with respect to the rear wall 13, top wall 14, and side walls 16 of the outer housing 11. It will therefore be seen that a rear plenum chamber 23 is defined between the rear walls of the housings, and side plenum chambers **23*a* are defined between the respective side walls of the housings. A top plenum chamber 23*b*** is defined between the top walls of the respective housings, the plenum chambers intercommunicating with each other and defining heating zones where air is heated.

The interior of the inner housing 12 defines a fire or combustion chamber 22 which is provided with a fire resistant lower wall 24. In this regard, the lower wall 24 may be formed of a suitable fire resistant cement of the type which is well known in this art. A pair of elongate bolts 25 extend through openings in the lower wall 15 of the outer housing 11 and each is provided with a nut 26 located below the lower wall. These bolts serve as leveling legs to permit the rear portion of the fireplace insert to be leveled when the insert is installed in a fireplace recess. It is pointed out that the leveling legs will be installed prior to the information of the fire resistant bed 24.

The fireplace insert heater 10 also includes a vertically disposed flue stack 27 which is secured to the top wall 19 of the inner housing 12 and projects through and is secured to the top wall 14 of the outer housing 11. The flue stack intercommunicates the combustion chamber 22 with the chimney P of the fireplace recess. It will also be noted that the inner housing 12 is provided with a plurality of spaced apart vertical support elements 28 each being rigidly affixed to the lower surface of the top wall 19 of the inner housing and projecting downwardly therefrom.

Each support element 28 has an inturned flange 29 which is horizontally disposed and which serves to support a generally rectangular shaped baffle plate 30. In the embodiment shown, the baffle plate 30 has upturned flanges 31 integral with the priphery thereof. It will be noted that the baffle plate 30 when supported on the support elements 28, is positioned below the lower end of the flue stack 27 in generally obstructing relation thereto. With this arrangement, heated gases from the combustion chamber will be obstructed by the baffle plate to prevent direct passage thereof through the flue stack. Thus, the deflected gases will tend to circulate in the combustion chamber to minimize a heat loss through the flue stack.

The fireplace insert heater 10 also includes a front chamber structure 32 which is located exteriorly of the fireplace recess FP when the insert is installed in the fireplace recess. This top chamber structure 32 includes a front wall section 33 which is integral with the top wall 14 of the outer housing 11. The front wall section 33 is integral with and is bent at right angles with respect to the top wall 14 and is integral with an inclined top wall section 34. The top wall section 34 has a rear edge integral with a vertical rear wall section 35 which terminates in an inturned lower flange **35*a* which engages the upper surface of the top wall 14 of the outer housing 11. A chamber 36 is defined interiorly of the top chamber structure 32. Suitable insultation I is disposed between the rear wall section 35** and the front wall FW of the fireplace recess FP to define an insulated heat seal therebetween.

It will be noted that the top wall 19 of the inner housing projects upwardly beyond the front wall FW of the fireplace insert and is provided with a downturned flange 37 which is integral therewith and bent at right angles thereto. The downturned flange 37 terminates in an inturned flange 38 which is disposed substantially parallel to the top wall 19 of the inner housing 12. It will also be noted that, that portion of the fireplace insert 10 which is located exteriorly of the fireplace recess FP is provided with a bottom wall 40 which is disposed in substantially coplanar relation with the bottom wall 15 of the outer housing 11. The bottom wall 40 has an upturned rear flange 41 which engages the upturned flange 17 of the bottom 15 and is rigidly secured thereto. The bottom wall 40 is provided with a front flange 42 which is integral therewith and which projects upwardly therefrom, the front flange terminating in an inturned flange 43 spaced from and disposed substantially parallel to the bottom wall 40.

A front wall 39 is secured to the downturned flange 37 of the top wall 19 and the upturned front flange 42 of the bottom wall 40. The front wall 39 also cooperates with other elements to form a pair of side chamber structures 44, each of which includes a vertical, inner side wall 45, a vertical rear wall 46, and a vertical outer side wall 47. It will be noted that the inner and outer side walls of each side chamber structure 44 are secured to the front wall 39. Similarly, each inner and outer side wall of each side chamber structure is also secured to the associated rear wall 46. It will further be noted that the outer side wall 47 of each side chamber structure 44 is provided with a plurality of vertically spaced apart outwardly struck, downwardly facing louvers 48 to permit heated air to be discharged from the side chamber structures. The interior of 49 of each side chamber structure 44 communicates with one of the side plenum chambers **23*a* and with the chamber 36 of the top chamber structure 32**.

Means are provided for circulating air through the various plenum chambers of the fireplace insert and this means includes a pair of fan units 50 each being mounted within one of the side chamber structures 44 adjacent the lower end portion thereof. Each fan unit is adapted to discharge air rearwardly into the associated side plenum chamber **23*a*** and each is connected to a source of electric power to provide electrical current for operating the fan unit.

Figure 4:
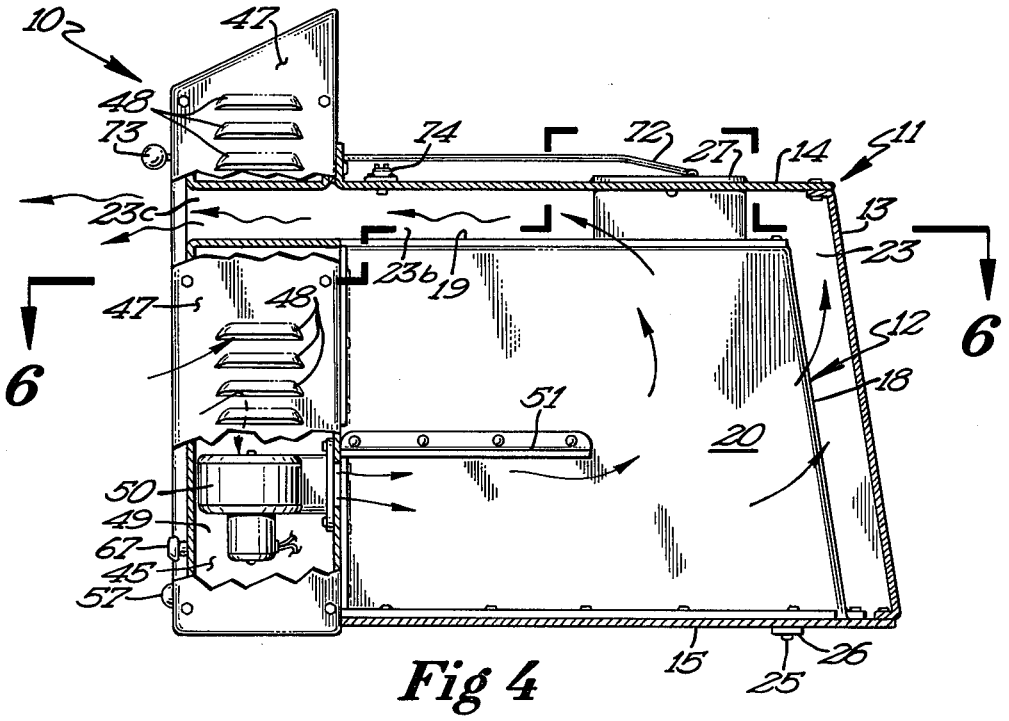
FIG. 4 is a cross-sectional view taken approximately along line 4—4 of FIG. 2 and looking in the direction of the arrows.
Figure 6:
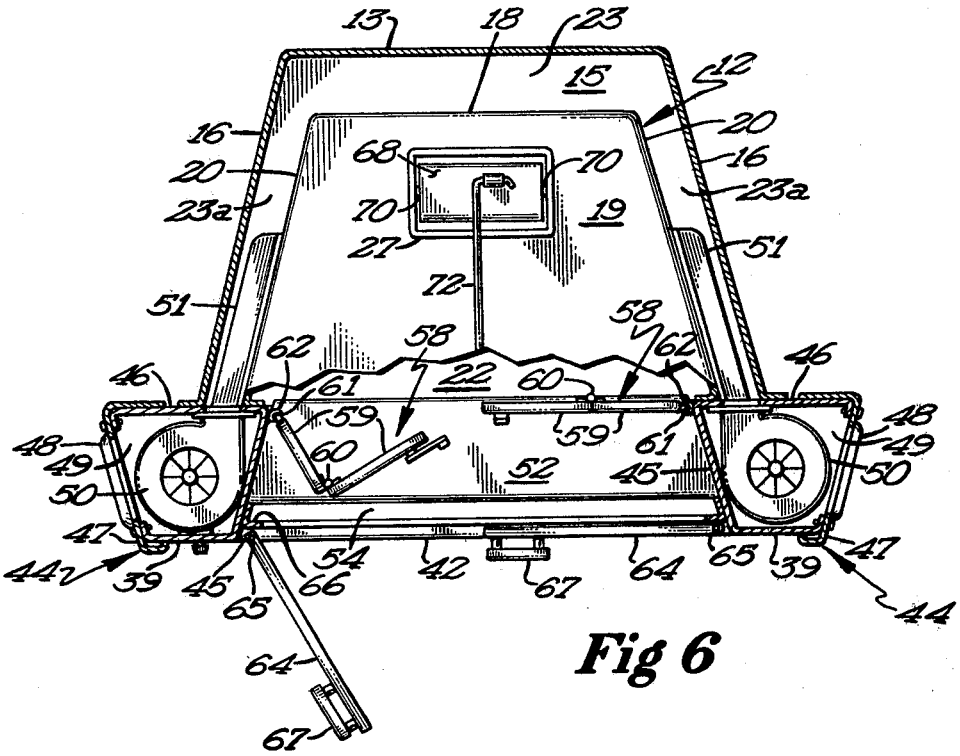
FIG. 6 is a cross-sectional view taken approximately along line 6—6 of FIG. 4 and looking in the direction of the arrows.
Figure 5:
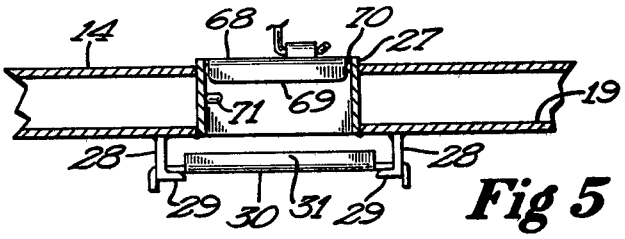
FIG. 5 is a cross-sectional view taken approximately along line 5—5 of FIG. 3 and looking in the direction of the arrows.
Figure 7:
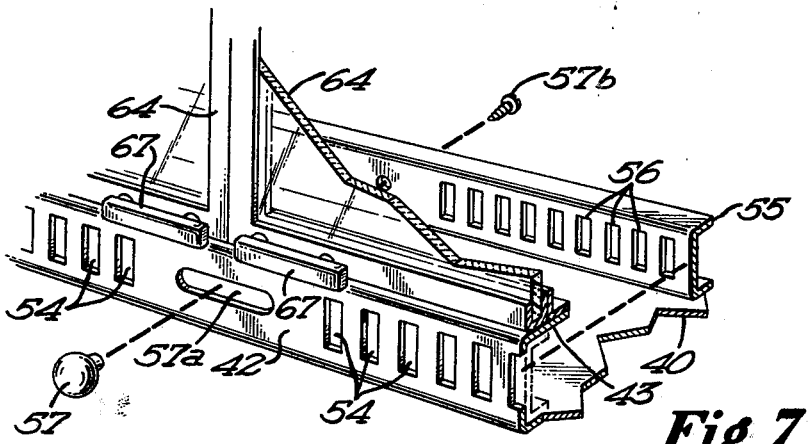
FIG. 7 is a fragmentary, perspective, exploded view illustrating the vent structure of the fireplace insert.

Means are also provided for controlling circulation of air directed rearwardly by the fan units and this means includes a pair of generally horizontally disposed baffle plates 51, each being positioned within one of said side plenum chambers **23*a* as best seen in FIGS. 4 and 6. It will be noted that each baffle plate 52 includes a vertical flange 52*a* which is rigidly secured to the associated side wall 20 of the inner housing 12. It will further be noted that the baffle plates 52 are located just above the discharge outlet 50*a* of the associated fan unit and extends a substantial distance transversely of the associated side plenum chamber. With this arrangement, the air which is impelled rearwardly by the fan unit 50 will be further directed rearwardly into the rear plenum chamber 23 rather than being permitted to rise into the upper plenum chamber 23*b*. Thus, the incoming air to be heated flows along the outer wall surfaces of the inner housing 12** whereby a good heat exchange action is obtained.

Means are also provided for controlling the quantity and the flow of air into the chamber 22 of the inner housing 12. This means includes a substantially flat baffle plate 52 which is mounted on a plurality of support brackets 53 which are mounted on the rear flange 41 of the bottom wall 40. It will be noted that the baffle plate 52 is spaced from the bottom wall 40 and has its front edge spaced from the front wall 39. The front wall 39 is also provided with a plurality of laterally spaced apart vertically extending vent openings 54 therein adjacent the lower portion thereof. It will be noted that the vent openings 54 extend substantially throughout the width dimension of the front wall. An elongate, transversely extending vertically oriented vent plate 55 is shiftably mounted on the rear surface of the front wall adjacent the vent openings 54 therein. The vent plate 55 is also provided with a plurality of openings 56 therein which are laterally spaced apart and which correspond in size and numbers to the vent openings 54 in the front wall 39. The vent plate 55 is also provided with an actuating handle 57 which projects outwardly beyond the front wall 39. By shifting the vent plate 55 in a lateral direction by movement of the handle 57, the openings 56 therein can be shifted relative to the openings 54 in the front wall. Thus, the size of the vent openings through the front wall can be selectively varied to control the amount of combustion air introduced into the inner housing chamber 22.

The insert is also provided with an inner pair of doors and an outer pair of doors for permitting access to the combustion chamber 22. The inner set of doors comprises a pair of steel doors 58, each door including a pair of generally rectangular shaped door panels 59 hingedly connected together along adjacent vertical edges by hinge 60 to permit relative hinging movement between each pair of door panels. The outer edge of the outer door panel 59 of each door is provided with a vertically disposed hinge pin 61 which projects vertically from the vertical edges of the door panel into openings in hinge brackets 62 which are secured to the vertical inner side wall 45 of each side chamber structure 44. With this arrangement, the steel doors they may be moved to a completely open condition where they are collapsed accordion fashion against the inner side walls 45 of the side wall chamber structures 45. When the doors are in the closed position, the doors obstruct the access opening into the combustion chamber. An elongate generally angle-shaped bracket 63 is affixed to the lower surface of the top wall 19 of the inner housing 12 and serves to limit pivoting movement of the doors 58 in a closing direction.

The outer set of doors for the fireplace insert includes a pair of glass doors 64 which are of generally rectangular shaped configuration and each has an elongate vertically disposed hinge pin 65 affixed thereto adjacent the outer vertical edge thereof. Each hinge pin 65 projects through an opening in each of a pair of vertically spaced apart brackets 66. One of the brackets is secured to the inturned flange 38 of the top wall 19 and the other brackets 66 is secured to the inturned flange 43 of the bottom wall 40. Suitable, horizontally disposed handles 67 are provided for the glass doors 64 to facilitate opening thereof. It will be seen that when the glass doors 64 and the steel doors 58 are in the closed position, a chamber C is defined between the respective doors. It will further be noted that combustion air enters this inner door chamber C through vent openings and must then pass upwardly over the baffle plate 52. The steel doors 58 are spaced slightly above the upper edges of the flanges 17 and 41 when the doors are in a closed position. Thus, the combustion chamber 22 will receive combustion air through the space 76 below the steel doors 58 even though the steel doors 58 are in the closed position.

Figure 3:
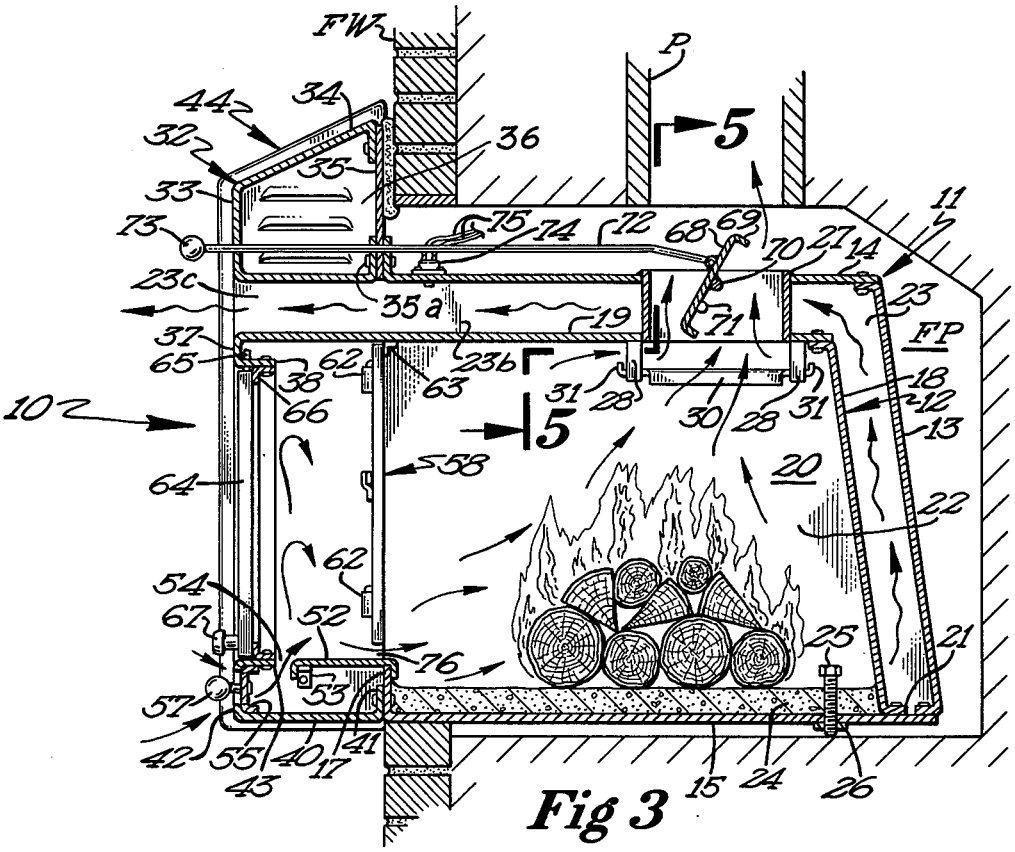
FIG. 3 is a cross-sectional view taken approximately along line 3—3 of FIG. 2 and looking in the direction of the arrows.

The fireplace insert is also provided with a substantially flat damper plate 68 having downturned peripheral flanges 69 and secured to a hinge pin 70 which is journaled in supports to permit vertical swinging movement of the damper plate about a substantially horizontal axis. It will be noted that the damper plate is positioned in the flue stack 27 and is shiftable between a completely horizontal position and an inclined position as illustrated in FIG. 3. A stop pin 71 affixed to the flue stack 27 limits pivotal movement of the damper plate in an inclined direction. It will further be noted that when the damper plate is in the completely horizontal position, the peripheral edges of the damper plate will be spaced inwardly from the inner periphery of the flue stack to permit smoke to pass around the damper plate.

Means are also provided for shifting the damper plate between the horizontal and inclined position and this means includes an elongate actuating rod 72 which is pivotally connected at one end to the damper plate. The actuating rod 72 projects through the rear wall section 35 and the front wall section 33 of the top chamber structure 32 and terminates in a knob 73 located exteriorly of the top chamber structure. It will be noted that the actuating rod 72 is positioned above the top wall 14 of the outer housing 11. By longitudinally shifting the actuating rod 72, the damper plate may be readily shifted between the horizontal and inclined positions.

It will also be noted that the upper plenum chamber 23 is completely open at its forward end to communicate with the room to be heated. A thermostat 74 is mounted on the top wall 14 of the outer housing and projects into the upper plenum chamber **23*b* and is set to be responsive to the changes in temperature of the air in the upper plenum chamber 23*b*. The thermostat is connected by suitable conductors 75 to a source of electrical current and to the fan unit 50** so that the operation of the fan units is controlled by the thermostat.

The novel fireplace insert may be readily inserted into a conventional fireplace with a minimum of effort. The fuel to be burned in the fireplace insert is positioned directly upon the fire resistant ceramic bed 24 rather than on a grate in the conventional manner. The air to be heated will be drawn into the plenum chambers through the louvered openings 48 and will be circulated over the walls of the inner housing to obtain optimum heat exchange therebetween. The heated air is completely contained within the walls of the outer housing and will be forceably discharged by the fan action into the room to be heated. The use of the damper plate minimizes any loss of heat through the chimney and the control of the combustion air permits fine control of the degree of combustion of the fuel in the combustion chamber.

Thus, it will be seen that I have provided a novel fireplace insert which is not only of simple and inexpensive construction, but one which functions in a more efficient manner than any heretofore know comparable fireplace insert.

It is anticipated that various changes can be made in the size, shape and construction of the fireplace insert device disclosed herein without departing from the spirit and scope of my invention as defined by the following claims.

What is claimed is:

1. A fireplace insert heater, an outer housing including upper, lower, rear and side walls, an inner housing spaced inwardly from said outer housing and having an interior defining a combustion chamber, said inner housing including upper, rear and side walls, spaced inwardly of the respective upper, rear and side walls of the outer housing to thereby define upper, rear and side plenum chambers between the corresponding walls of said inner and outer housings, the walls of said inner housing separating said plenum chambers in non-communicating relation from the combustion chamber, said inner housing separating said plenum chambers in non-communicating relation from the combustion chamber, said inner housing having a forwardly facing opening, said inner and outer housings adapted to be positioned within a fireplace recess, a horizontal top chamber structure secured to the top wall of the outer housing and adapted to be positioned exteriorly of the fireplace recess, a pair of laterally spaced apart side chamber structures located exteriorly of the fireplace recess and each having an interior communicating with said side plenum chambers, said side chamber structures having a common front wall extending between the side chamber structures, an access opening in the front wall, a pair of transparent doors hingedly mounted on said front wall, a pair of vertically disposed metallic sectional doors hingedly connected with said inner housing and being swingable between closed and open positions, said metallic doors when in the closed position closing the forwardly facing opening in the inner housing, and when in the open position being disposed in the space between the inner housing and the front wall of the outer housing to completely expose the opening in the inner housing, a plurality of laterally spaced apart openings in said front wall adjacent the lowe portion of the latter and extending between said side chambe structures, means for variously adjusting the size of said openings to vary the amount of air introduced into the combustion chamber, a vertically disposed flue stack extending through the upper walls of the inner and outer housings to intercommunicate the combustion chamber with the chimmney of the fireplace, said flue stack being spaced laterally inwardly from the respective side walls of said inner and outer housing, a baffle plate positioned in the combustion chamber below and in confronting relation with the flue stack, fans in said side chamber structures for impelling air rearwardly into the side plenum chambers, and a pair of substantially flat, horizontally disposed baffle plates each being positioned in one of said side plenum chambers for directing air impelled by said fans in a rearward direction.

2. The fireplace insert heater as defined in claim 1 wherein said means for adjusting the vent openings in the front wall comprises an elongate horizontally disposed plate having a plurality of openings therein and being positioned against the rear surface of said front wall, said plate being laterally shiftable relative to said front wall between open and closed positions to variously adjust the effective size of the vent openings, said plate when in the closed position obstructing the openings in said front wall, and when in the open position having each opening in the plate disposed in registering relation with an opening in the front wall.

3. The fireplace insert heater as defined in claim 1 wherein said vent openings and shiftable plate are located below said transparent doors.

4. The fireplace insert heater as defined in claim 1 and vertically adjustable leveling means secured to the lower wall of said outer housing and being shiftable relative thereto for facilitating leveling of said fireplace insert.

5. The structure as defined in claim 4 and a moveable damper plate positioned in said flue stack, means connected with the damper plate and extending outwardly of said front wall and being operable to vary the size of the opening of each flue stack.

* * * * *